US006191400B1

(12) United States Patent
Cunningham

(10) Patent No.: US 6,191,400 B1
(45) Date of Patent: Feb. 20, 2001

(54) METAL SHEATH HEATING ELEMENT AND METHOD OF MANUFACTURING SAME

(75) Inventor: Donald M. Cunningham, Pittsburgh, PA (US)

(73) Assignee: Emerson Electric Co., St. Louis, MO (US)

( * ) Notice: Under 35 U.S.C. 154(b), the term of this patent shall be extended for 0 days.

(21) Appl. No.: 09/422,435

(22) Filed: Oct. 21, 1999

(51) Int. Cl.[7] ..... H05B 3/02

(52) U.S. Cl. ..... 219/546; 219/543; 219/544; 392/503

(58) Field of Search ..... 219/270, 523, 219/534, 535, 541, 543, 544, 546, 548, 553; 392/503; 338/230, 238, 241, 243, 246, 251, 264, 270, 274, 321

(56) References Cited

U.S. PATENT DOCUMENTS

| | | | | |
|---|---|---|---|---|
| 3,839,623 | * | 10/1974 | Portmann | 219/541 |
| 4,115,686 | * | 9/1978 | Williams et al. | 219/523 |
| 4,150,281 | * | 4/1979 | Hinz | 219/535 |
| 4,238,671 | * | 12/1980 | Gellert | 219/544 |
| 4,424,439 | * | 1/1984 | Payne et al. | 219/544 |
| 5,066,852 | * | 11/1991 | Willbanks | 219/544 |
| 5,095,193 | * | 3/1992 | Doyle | 219/544 |
| 5,251,589 | * | 10/1993 | Duba et al. | 219/270 |
| 5,380,987 | * | 1/1995 | Morici | 219/544 |
| 5,811,761 | * | 9/1998 | Kita et al. | 219/270 |
| 5,875,283 | * | 2/1999 | Yane et al. | 219/544 |
| 5,965,049 | * | 10/1999 | Carlet | 219/546 |

* cited by examiner

*Primary Examiner*—Teresa Walberg
*Assistant Examiner*—Fadi H. Dahbour
(74) *Attorney, Agent, or Firm*—Howrey Simon Arnold & White, LLP

(57) ABSTRACT

A metal sheath heating element for substantially dry applications is disclosed. In one embodiment, the heater is substantially elongate and cylindrical, and comprises a coiled resistive heater wire. The heater wire is disposed within a stainless steel outer sheath. Granular insulating material is introduced into the sheath to electrically insulate the heating element from the outer sheath, and to thermally conduct heat from the heating element to the sheath. At least one small hole is formed in outer sheath to permit any moisture trapped therein to escape, advantageously minimizing the potential for current leakage between the heating element and the outer sheath, as well as minimizing the likelihood of depletion of oxygen from the filler material due to oxidation occurring within the sheath. In one embodiment, a plurality of holes are formed at spaced intervals along the length of the sheath.

11 Claims, 2 Drawing Sheets

METAL SHEATH HEATING ELEMENT AND METHOD OF MANUFACTURING SAME

FIELD OF THE INVENTION

This invention relates generally to the field of electric heaters, and more particularly to a metal sheath heating element and a method of manufacturing same.

BACKGROUND OF THE INVENTION

Various configurations of metal sheath heating elements are known in the prior art. A typical tubular heating element comprises a coiled resistance wire extending coaxially along the length of an elongate metal sheath. An insulating material having an optimum combination of relatively high thermal conductivity and relatively low electrical conductivity is used to fill the space between the coil and the inner wall of the sheath. Granulated magnesium oxide is one substance known to be suitable for the purposes of serving as the insulating filler material. Toward the end of the manufacturing process, the granulated magnesium oxide is introduced into the sheath, for example by gravity feed. Upon sealing the sheath, the sheath is subjected to compression forces, for example, by swaging, pressing, or the like, thereby compacting the granulated magnesium oxide to improve its dielectric and thermal conductive properties.

Depending upon the intended application, metal sheath heating elements of varying sizes and voltage ratings may be required. In many applications, a relatively high voltage, on the order of 480 volts or so, may be desired.

Metal sheath heating elements are often used in radiant heaters for industry, for providing comfort heating in unheated areas such as steel mills, loading docks, and maintenance areas, for example. In such applications, the heating elements are subjected to seasonal usage cycles. During the summer months, the heating elements are not energized. Depending on the humidity, such seasonal usage provides an opportunity for the insulating filler material, which is typically hygroscopic, to absorb moisture, for example, through the terminal ends of the metal sheath from which the electric supply wires extend.

If moisture is permitted to accumulate within a heating element's sheath and the heating element is then energized, the moisture inside the sheath is driven by heat to the colder terminal ends and can accumulate in high concentration. If the accumulation of moisture becomes high enough, the electrical resistivity of the insulating filler material may diminish to the point that the insulating material may not be able to withstand the line voltage, particularly in high-voltage heaters. Depending upon the amount of moisture involved, this can lead to leakage current through the metal sheath. In some cases, the heater may short to ground through the metal sheath. In the worst cases, complete breakdown can occur.

In some applications, a metal sheath heating element can be provided with hermetic terminal seals to completely prevent moisture infiltration into the sheath. One known approach is to provide a seal consisting of a high-grade, dense, cylindrical ceramic insulator fused to a metal component part at each end of the sheath, the ceramic insulator then being brazed to the sheath itself. Other approaches to hermetic sealing of heating elements are known. Hermetic sealing may not be appropriate in all circumstances, however, particularly in high-temperature applications. Even if a heating element is hermetically sealed, a residual amount of oxygen typically remains within the sealed sheath. At very high temperatures, the interior surface of the sheath and the coiled heating wire itself will tend to react with any oxygen present (i.e., oxidize). Once the residual oxygen is depleted through such oxidation, any further oxidation of the sheath and heating wire can only occur through breakdown of the magnesium oxide filler material. As this occurs, the filler material tends to become increasingly "metal rich," tending to adversely impact its dielectric properties. This leads to poorer heating element performance and can ultimately lead to complete breakdown of the element.

The aforementioned problems relating to oxidation of the filler material can similarly occur even if the sheath is not hermetically sealed. This effect is even more pronounced in very long tubular heating elements.

SUMMARY OF THE INVENTION

In view of the foregoing considerations, the present invention is directed in one respect to a heating element adapted to counteract the undesirable consequences of moisture build-up within its metal sheath.

In accordance with one aspect of the invention, the metal sheath of a tubular heating element is provided with one or more pin-holes along its length. The pin-holes allow moisture to escape from the sheath more uniformly along its length, avoiding concentrations of moisture at particular locations. This advantageously reduces leakage current and the likelihood of complete breakdown of the insulating filler material.

In accordance with another aspect of the invention, the provision of one or more holes a heating element's sheath minimizes the likelihood of depletion of oxygen from the filler material which can result from oxidation of the interior wall of the heating element and the coiled heater wire, even in very long heating elements.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION OF SPECIFIC EMBODIMENTS OF THE INVENTION

In the disclosure that follows, in the interest of clarity, not all features of actual implementations are described. It will of course be appreciated that in the development of any such actual implementation, as in any such project, numerous engineering and design decisions must be made to achieve the developers' specific goals and subgoals (e.g., compliance with system- and business-related constraints), which will vary from one implementation to another. Moreover, attention will necessarily be paid to proper engineering and design practices for the environment in question. It will be appreciated that such a development effort might be complex and time-consuming, but would nevertheless be a routine undertaking for those of ordinary skill in the field of electric heaters.

Figure 1:
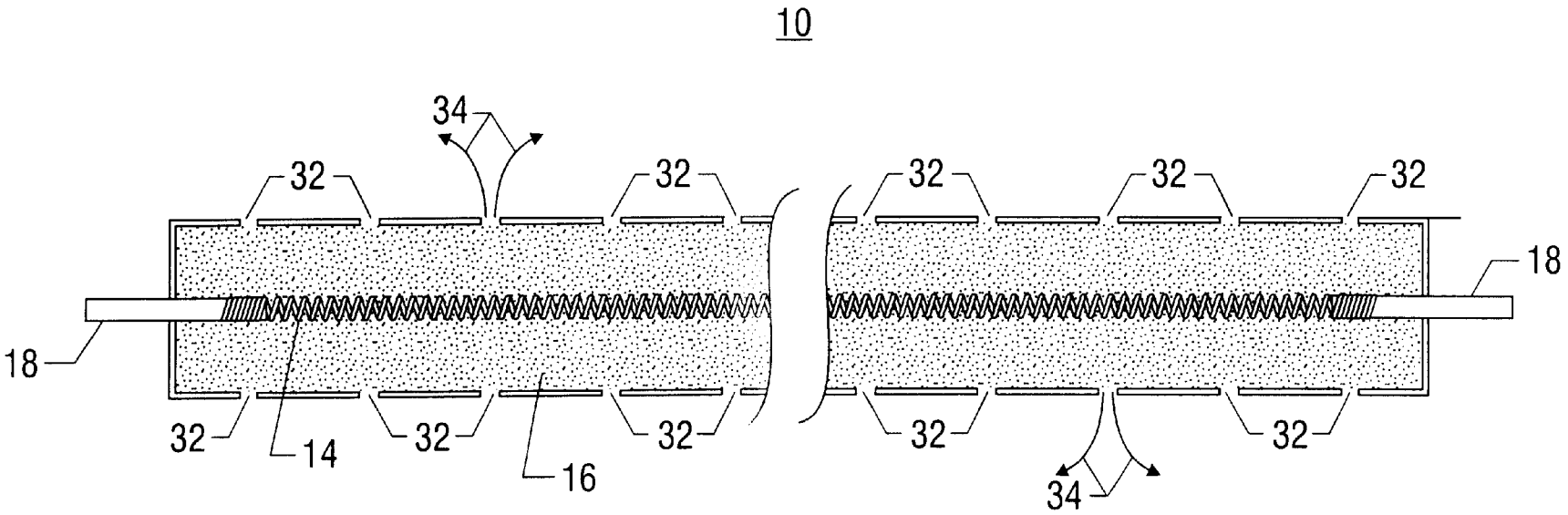
FIG. 1 is a cross-sectional side view of a tubular metal sheath heating element in accordance with one embodiment of the invention.

Referring to FIG. 1, there is shown a side cross-sectional view of a tubular metal sheath heating element 10 in accordance with one embodiment of the invention. In the embodiment of FIG. 1, heating element 10 comprises an elongate metal sheath 12 within which a coiled resistive heating wire 14 extends, in an essentially conventional configuration. Heating wire may be made, for example, from a nickel-chromium alloy. Outer sheath 12 may made of, for example, stainless steel, Incoloy®, steel, copper, lnconel®, Monel®, titanium, or the like. Sheath 12 may be made of welded tubing (i.e., tubing having a welded seam extending along its length, or from seamless tubing.

In the space between the inner diameter of sheath 12 and heating element wire 14 is an electrically insulating, thermally conductive filler material 16. In the presently disclosed embodiment, filler material 16 is granulated magnesium oxide. Advantageously, magnesium oxide 16 is known to be capable of withstanding high operating temperatures while at the same time serving as an electrical insulator resistant to leakage of current between heating element 14 and metal sheath 16.

With continued reference to FIG. 1, operating power is supplied to heating element 10 by means of two terminal pins 18, one extending out of each end of sheath 12. In the presently disclosed embodiment. Resistor wire 14 is preferably welded to terminal pins 18 to ensure a positive electrical and mechanical connection.

Manufacture of heating element 10 as described herein involves insertion of the resistor wire 14 into sheath 12, with terminal pins 18 extending out of opposite ends. Granular filler material 16 is introduced into sheath 12, and then heater 10 is subjected to compression forces to fully compact filler material 16 within sheath 12. Such compression can be accomplished by swaging, rolling, or pressing sheath 12, and advantageously improves the thermal and electrical properties of filler material 18.

Once all components are assembled and the heating element 10 has been compressed, the terminal hardware 30 is applied, for example, by welding, over the respective ends of sheath 12. Various configurations of terminal hardware are known, including hermetic sealing hardware; the particular configuration of terminal hardware used is not believed to be of any particular consequence to the present invention.

Although various end capping methodologies are known to render heater 10 generally resistant to moisture, the seals around terminal pins 18 may be less than perfect. Under certain environmental conditions, therefore, it is possible for moisture and humidity to seep into sheath 12 to be absorbed by filler material 16. Granulated magnesium oxide, for example, is known to be hygroscopic, heightening the possibility of undesirable moisture infiltration.

As noted in the Background of the Invention above, if enough moisture is permitted to infiltrate sheath 12, the dielectric integrity of filler material 16 can be compromised, leading to partial or complete dielectric breakdown, i.e., a short circuit between heating wire 14 and sheath 12. In the presently disclosed design, the only possible path of exit of the moisture is at the ends where terminal pins 18 pass into sheath 12. If sufficient moisture is allowed to infiltrate sheath 12, when heater 10 is subsequently energized, the resulting heat will cause the moisture to concentrate generally near the ends. The potential for current leakage or short-circuiting between heater wire 14 and sheath 12 is undesirably heightened at such areas of moisture concentration.

In accordance with a notable aspect of the invention, therefore, sheath 12 in accordance with the presently disclosed embodiment has at least one hole 32 formed therein to enable moisture to escape from sheath 12 from at least one location other than the proximal end thereof. As shown in FIG. 1, in one embodiment, a plurality of small holes 32 are provided along the length of sheath 12, enabling trapped moisture to escape from sheath 12 at multiple locations along its length, rather than merely at the proximal end thereof. The provision of holes 32 also advantageously minimizes the likelihood of depletion of oxygen from filler material 16 due to oxidation of the interior surface of sheath 12 and heating wire 14; such depletion is is particularly possible in applications involving very long heating elements.

It is to be understood that holes 32 are not shown to scale in FIG. 1; in one embodiment, holes 32 are formed in sheath 12 using a laser beam having a diameter of approximately 0.005 inches in diameter. Those of ordinary skill in the art having the benefit of the present disclosure will appreciate that other means for forming holes 32 might be employed, including, without limitation, electron beams, drills, waterjets, and the like. Alternatively, in embodiments in which sheath 12 is made from welded tubing, holes 32 may be created during the formation of the tubing, for example, by periodically interrupting the normally continuous weld along the length of the tubing. The escape of moisture through holes 32 is symbolically represented by arrows 34 in FIG. 1.

Those of ordinary skill in the art will appreciate that the provision of holes 32 in sheath 12 renders heater 10 inappropriate for applications in which it is to be immersed or otherwise exposed to liquids. However, in substantially dry applications, and for largely seasonal applications, holes 32 advantageously minimize the problems associated with infiltration of moisture. It is contemplated that the number and locations of holes 32 may vary from implementation to implementation, and it is believed that it would be a matter of routine engineering for those of ordinary skill in the art having the benefit of the present disclosure to select an appropriate layout and distribution of holes 32 in any given implementation of the present invention.

Figure 2:
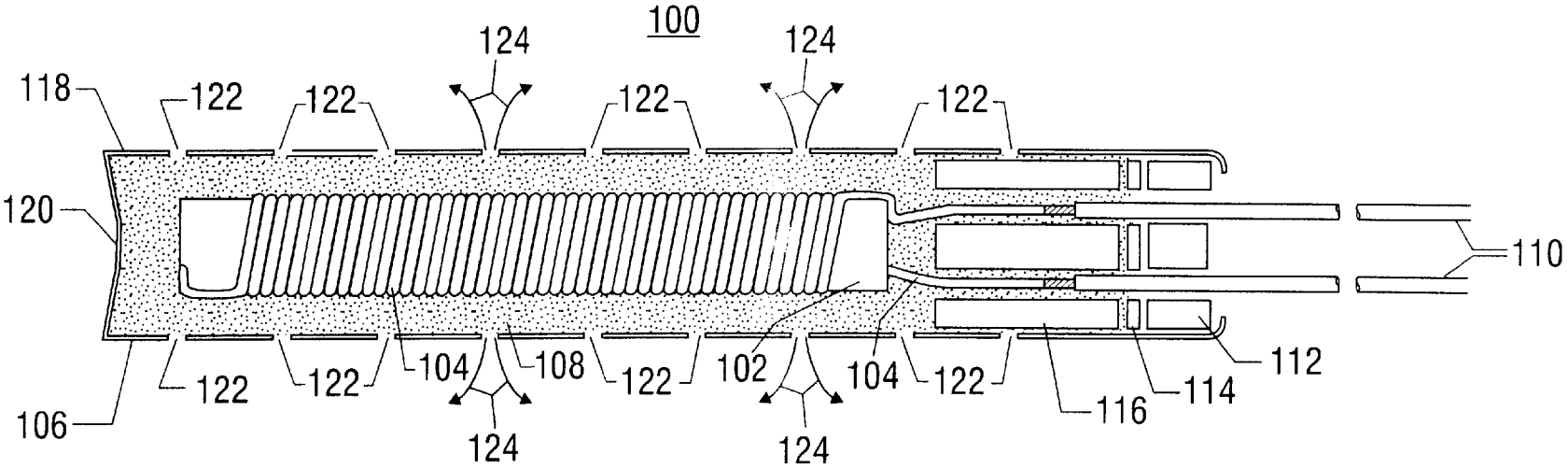
FIG. 2 is a cross-sectional side view of a cartridge-type metal sheath heating element in accordance with another embodiment of the invention.

Turning now to FIG. 2, there is shown a side cross-sectional view of a heating element 100 in accordance with an alternative embodiment of the invention. Although the embodiment of FIG. 2 comprises a cartridge-type heating element rather than the tubular type of the embodiment of FIG. 1, those of ordinary skill in the art will recognize many similarities between the two embodiments. In FIG. 2, heating element 100 comprises an elongate heater element wind core 102 about which a resistive heating wire 104 is coiled, in an essentially conventional configuration. Like the embodiment of FIG. 1, wind core 102 in the embodiment of FIG. 2 is made of magnesium oxide, and is substantially cylindrical.

Wind core 102 and coiled wire 104 are disposed within an outer sheath 106 made of, for example, stainless0 steel or the like. In the space between the inner diameter of sheath 106 and heating element 14 is an electrically insulating, thermally conductive filler material 108. Again, granulated magnesium oxide is a preferred filler material for this purpose due to its physical, thermal, and electrical characteristics.

With continued reference to FIG. 2, operating power is supplied to heating element 10 by means of two supply wires 110. Wires 110 enter the proximal end of heater 100 through a Teflon™ end plug 112 and a mica disk 114 each having appropriately sized through-holes formed therein. Wires 110 then pass into a dummy core 116 of insulating material, such that at least a portion of the Teflon™ coating of wires 110 extends into dummy core 116. Within dummy core 106, electrical contact is made between wires 110 and coiled heating element wire 104.

Manufacture of heating element 100 as described herein involves insertion of the various components from an open, distal end 118 of sheath 106, with supply wires 110 each extending out of the proximal end of sheath 106. Once the components are in place, the granular filler material 108 is introduced into sheath 106 and an end cap 120 is applied, for example, by welding, over distal end 118. Thereafter, heater 100 is subjected to the above-described swaging process, to reduce the overall diameter of sheath 106 and consequently cause filler material 108 to be compressed around heater core 102 and heating wire 104. Such compression advantageously improves the thermal and electrical properties of filler material 108.

Although Teflon™ end plug 112 and mica disk 114 render heater 100 generally resistant to moisture, as in the embodiment of FIG. 1 the seal around supply wires 110 may be less than perfect. This may be true even if other sealing means are employed, such as, for example, an epoxy resin or the like, in place of Teflon™ plug 112. Under certain environmental conditions, it is possible for moisture and humidity to seep into sheath 106 to be absorbed by filler material 108.

As in the embodiment of FIG. 1, if enough moisture is permitted to infiltrate sheath 16, the dielectric integrity of filler material 108 can be compromised, leading to partial or complete dielectric breakdown, i.e., a short circuit between heating wire 104 and sheath 106. In the embodiment of FIG. 2, the only possible path of exit of the moisture is at the proximal end where supply wires pass into sheath 16. If sufficient moisture has been allowed to infiltrate sheath 106, when heater 100 is subsequently energized, the resulting heat will cause the moisture to concentrate generally near the proximal end. The potential for current leakage or short-circuiting between heater wire 104 and sheath 106 is undesirably heightened at the area of moisture concentration. In a cartridge-type heating element as shown in FIG. 2, another potential failure mode involves a line-to-line short circuit between supply wires 110.

Accordingly, sheath 16 in the embodiment of FIG. 2 has at least one hole formed therein to enable moisture to escape from therefrom at at least one location other than the proximal end thereof. As shown in FIG. 2, in this embodiment, a plurality of small holes 122 are provided along the length of sheath 106, enabling trapped moisture to escape from sheath 106 at multiple locations along its length, rather than merely at the proximal end thereof. Again, holes 122 may formed in sheath 106 using various known techniques. The escape of moisture through holes 122 is symbolically represented by arrows 124 in FIG. 1.

Those of ordinary skill in the art will appreciate that the provision of holes 122 in sheath 106 renders heater 100 inappropriate for applications in which it is to be immersed or otherwise exposed to liquids. However, in substantially dry applications, and for largely seasonal applications, holes 122 advantageously minimize the problems associated with infiltration of moisture.

From the foregoing detailed description of specific embodiments of the invention, it should be apparent that a heating element for substantially dry, seasonal applications has been disclosed. Although specific embodiments of the invention have been disclosed herein in some detail, this has been done solely for the purposes of illustrating various aspects and features of the invention, and is not intended to be limiting with respect to the scope of the invention. It is contemplated that various substitutions, alterations, and/or modifications, including but not limited to those design alternatives which might have been specifically noted in this disclosure, may be made to the disclosed embodiment without departing from the spirit and scope of the invention as defined in the appended claims.

Specifically, those of ordinary skill in the art having the benefit of the present disclosure will appreciate that the present invention may be advantageously practiced in connection with heaters of essentially any size and configuration (e.g., tubular, cartridge, and so one) and of essentially any wattage, voltage, or current rating. A filler material 18 or insulating structure other than granulated magnesium oxide may be utilized. For example, a substantially hollow cylindrical heating element sheath made of pre-compressed magnesium oxide may be provided, as is disclosed in co-pending U.S. Pat. application Ser. No. 09/412,666 filed on Oct. 5, 1999, may be used. Those of ordinary skill in the art having the benefit of the present disclosure will recognize the applicability of the present invention to such an embodiment. Further, the number and placement of holes in the sheath may be varied as appropriate in given applications.

What is claimed is:

1. An electric heater, comprising:

a coiled resistive heater wire;

an octer sheath, disposed around said coiled heater wire, said outer sheath having at least one hole formed therein to enable moisture within said sheath to escape, the electric heater further comprising granular filler material interposed between the heater wire and an inner surface of the outer sheath.

2. A heater in accordance with claim 1, wherein said granular filler material is magnesium oxide.

3. A heater in accordance with claim 1, wherein said at least one hole has a diameter of approximately 0.005 inch.

4. A heater in accordance with claim 1, wherein said at least one hole comprises a plurality of holes at spaced intervals along the length said sheath.

5. A method of manufacturing a heater, comprising:

(a) disposing a heater element comprising a coiled resistive within an outer sheath;

(b) introducing granular filler material into the sheath;

(c) forming at least one hole in said outer sheath to permit the escape of trapped moisture within said sheath.

6. A method in accordance with claim 5, further comprising:

(d) capping said sheath; and (e) applying compression force to said sheath to compress said granular material.

7. A method in accordance with claim 6, wherein said granular material is electrically insulating and thermally conducting.

8. A method in accordance with claim 5, wherein said at least one hole has a diameter of approximately 0.005 inch.

9. A method of preventing current leakage in a heater having a heater wire, a conductive outer sheath, granular filler material interposed between the heater wire and an inner surface of the outer sheath comprising forming at least one hole in said outer sheath.

10. A method in accordance with claim 9, wherein said at least one hole has a diameter of approximately 0.005 inch.

11. A method in accordance with claim 9, wherein said step of forming at least one hole comprises forming a plurality of holes spaced along the length of said outer sheath.

* * * * *

UNITED STATES PATENT AND TRADEMARK OFFICE

CERTIFICATE OF CORRECTION

PATENT NO. : 6,191,400 B1
DATED : February 20, 2001
INVENTOR(S) : Donald M. Cunningham It is certified that error appears in the above-identified patent and that said Letters Patent is hereby corrected as shown below:

Column 6,
Line 25, delete "octer" insert "outer";
Line 26, insert "unfilled" before "hole";
Line 34, insert "unfilled" before "hole";
Line 36, insert "unfilled" before "hole";
Line 36, insert "unfilled" before "holes";
Line 42, insert "unfilled" before "hole";
Line 53, insert "unfilled" before "hole";
Line 58, insert "unfilled" before "hole"
Line 58, insert "to permit the escape of trapped moisture with said sheath" after "sheath";
Line 60, insert "unfilled" before "hole";
Line 62, insert "unfilled" before "hole";
Line 63, insert "unfilled" before "holes".

Signed and Sealed this

Seventh Day of August, 2001

*Attest:*

Nicholas P. Godici

*Attesting Officer*

NICHOLAS P. GODICI
*Acting Director of the United States Patent and Trademark Office*